US009915452B2

(12) United States Patent
Christians et al.

(10) Patent No.: US 9,915,452 B2
(45) Date of Patent: Mar. 13, 2018

(54) SUPPORT SHEET ARRANGEMENT FOR FALLING FILM EVAPORATOR

(71) Applicant: Carrier Corporation, Farmington, CT (US)

(72) Inventors: Marcel Christians, Skaneateles, NY (US); Satyam Bendapudi, Fayetteville, NY (US); Jack Leon Esformes, Jamesville, NY (US)

(73) Assignee: CARRIER CORPORATION, Farmington, CT (US)

( * ) Notice: Subject to any disclaimer, the term of this patent is extended or adjusted under 35 U.S.C. 154(b) by 309 days.

(21) Appl. No.: 14/259,811

(22) Filed: Apr. 23, 2014

(65) Prior Publication Data

US 2014/0311182 A1 Oct. 23, 2014

Related U.S. Application Data

(60) Provisional application No. 61/815,075, filed on Apr. 23, 2013.

(51) Int. Cl.

| | |
|---|---|
| ***F25B 39/02*** | (2006.01) |
| ***F28F 9/00*** | (2006.01) |
| ***F28D 7/16*** | (2006.01) |
| *F28D 21/00* | (2006.01) |

(52) U.S. Cl.

CPC ..... *F25B 39/028* (2013.01); *F28D 7/16* (2013.01); *F28F 9/00* (2013.01); *F28D 2021/0071* (2013.01)

(58) Field of Classification Search

CPC ..... F28D 2021/0064; F28D 7/16; F28D 2021/0071; F28F 9/00; F25B 39/028

See application file for complete search history.

(56) References Cited

U.S. PATENT DOCUMENTS

| | | | | |
|---|---|---|---|---|
| 2,854,828 | A | 10/1958 | Garland | |
| 4,572,766 | A | 2/1986 | Dimitriou | |
| 5,839,294 | A * | 11/1998 | Chiang | F25B 39/02 165/117 |
| 6,167,713 | B1 | 1/2001 | Hartfield et al. | |
| 6,293,112 | B1 | 9/2001 | Moeykens et al. | |
| 6,572,689 | B2 | 6/2003 | Cosby, II et al. | |
| 6,830,099 | B2 | 12/2004 | Moeykens | |
| 6,868,695 | B1 | 3/2005 | Dingel et al. | |
| 7,073,572 | B2 | 7/2006 | Ayub et al. | |
| 7,421,855 | B2 | 9/2008 | Ring et al. | |

(Continued)

FOREIGN PATENT DOCUMENTS

GB 909021 A 10/1962

*Primary Examiner* — Len Tran
*Assistant Examiner* — Ana Vazquez
(74) *Attorney, Agent, or Firm* — Cantor Colburn LLP

(57) ABSTRACT

A falling film evaporator for a heating ventilation and air conditioning (HVAC) system includes an evaporator housing and a plurality of evaporator tubes located in the evaporator housing and arranged into one or more tube bundles. A volume of thermal energy transfer medium is flowed through the plurality of evaporator tubes. One or more support sheets located along a length of the plurality of evaporator tubes to position and support the plurality of evaporator tubes in the housing, the one or more support sheets including one or more vapor flow passages to allow flow of vapor refrigerant along a length of the evaporator.

16 Claims, 4 Drawing Sheets

(56) References Cited

U.S. PATENT DOCUMENTS

| | | | | |
|---|---|---|---|---|
| 7,849,710 | B2 | 12/2010 | De Larminat et al. | |
| 8,302,426 | B2 | 11/2012 | De Larminat et al. | |
| 2008/0148767 | A1 | 6/2008 | De Larminat et al. | |
| 2009/0178790 | A1* | 7/2009 | Schreiber | F25B 39/028 165/158 |
| 2011/0017432 | A1* | 1/2011 | Kulankara | F28D 3/02 165/115 |
| 2012/0118545 | A1 | 5/2012 | Ayub et al. | |

* cited by examiner

SUPPORT SHEET ARRANGEMENT FOR FALLING FILM EVAPORATOR

BACKGROUND

The subject matter disclosed herein relates to heating, ventilation and air conditioning (HVAC) systems. More specifically, the subject matter disclosed herein relates to evaporators for HVAC systems.

HVAC systems, such as chillers, use an evaporator to facilitate a thermal energy exchange between a refrigerant in the evaporator and a medium flowing in a number of evaporator tubes positioned in the evaporator. In a flooded evaporator, the tubes are submerged in a pool of refrigerant. In the flooded evaporator system, compressor guide vanes and system metering tools control a total rate of refrigerant circulation through the system. The specific requirement of maintaining an adequate refrigerant level in the pool is achieved by merely maintaining a level of charge, or total volume of refrigerant in the system.

Another type of evaporator used in chiller systems is a falling film evaporator. In a falling film evaporator, bundles or groups of evaporator tubes are positioned typically below a distribution manifold from which refrigerant is urged, forming a "falling film" on the evaporator tubes. The falling film terminates in a refrigerant pool at a bottom of the falling film evaporator. In normal typical evaporator construction, the evaporator tubes are supported by a number of support sheets spaced along the length of the tubes, while a baffle is installed around a suction nozzle to protect the compressor from entrained liquid droplets. This baffle effectively blocks upward vapor flow below the baffle, in a section bounded by two support sheets nearest the suction nozzle. To compensate for this blockage, a large vertical gap, on the order of 6-7 inches, is left between the top edges of the support sheets and the bottom face of the baffle to redistribute upward vapor flow around the baffle. This large gap translates into undesired increased height of the evaporator, and is less than optimal in increasing the uniformity of upward vapor flow.

BRIEF SUMMARY

In one embodiment, a falling film evaporator for a heating ventilation and air conditioning (HVAC) system includes an evaporator housing and a plurality of evaporator tubes located in the evaporator housing and arranged into one or more tube bundles. A volume of thermal energy transfer medium is flowed through the plurality of evaporator tubes. One or more support sheets located along a length of the plurality of evaporator tubes to position and support the plurality of evaporator tubes in the housing, the one or more support sheets including one or more vapor flow passages to allow flow of vapor refrigerant along a length of the evaporator.

In another embodiment, a heating, ventilation and air conditioning (HVAC) system includes a condenser flowing a flow of refrigerant therethrough and a falling film evaporator in flow communication with the condenser. The falling film evaporator includes an evaporator housing and a plurality of evaporator tubes located in the evaporator housing and arranged into one or more tube bundles. A volume of thermal energy transfer medium is flowed through the plurality of evaporator tubes. One or more support sheets located along a length of the plurality of evaporator tubes to position and support the plurality of evaporator tubes in the housing, the one or more support sheets including one or more vapor flow passages to allow flow of vapor refrigerant along a length of the evaporator.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
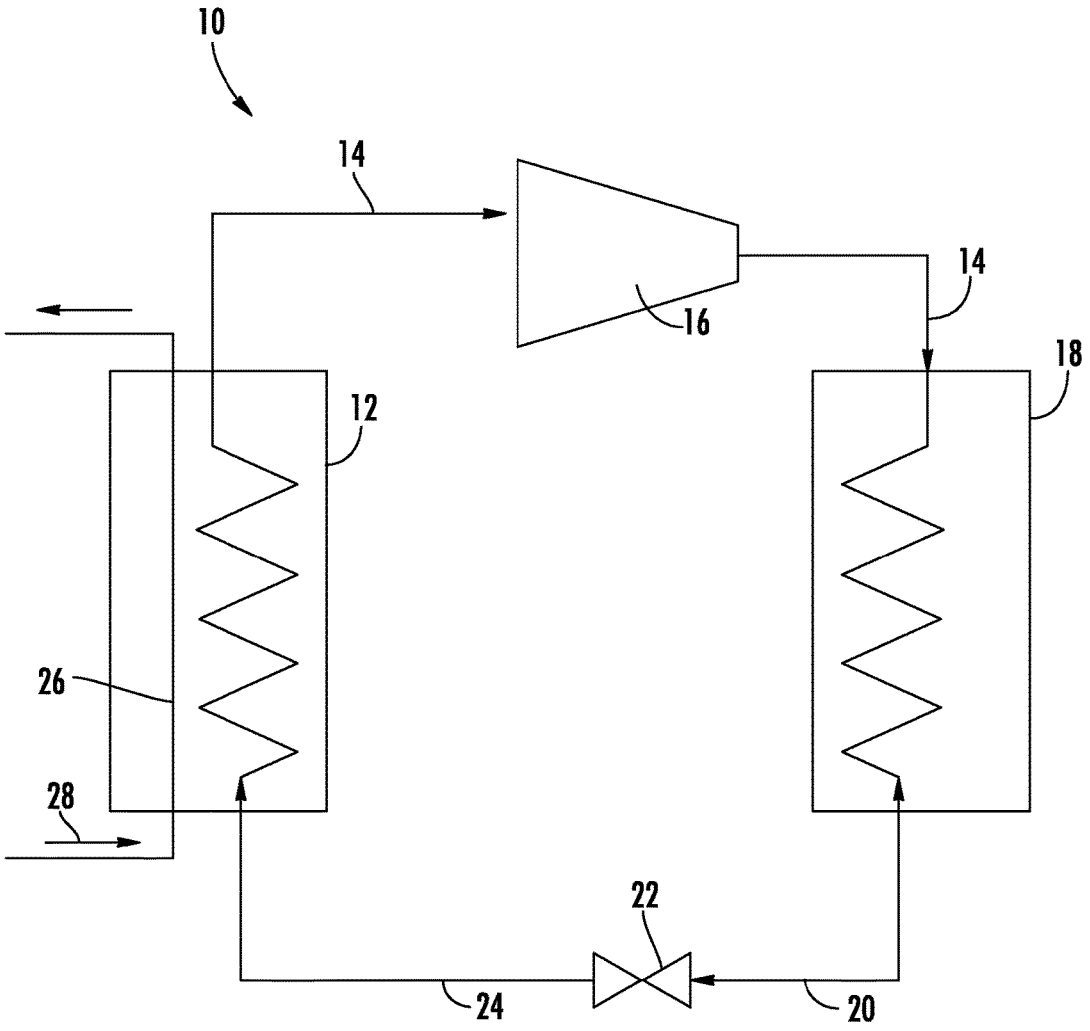
FIG. 1 is a schematic view of an embodiment of a heating, ventilation and air conditioning system.

The detailed description explains embodiments of the invention, together with advantages and features, by way of example with reference to the drawing.

DETAILED DESCRIPTION

Shown in FIG. 1 is a schematic view of an embodiment of a heating, ventilation and air conditioning (HVAC) unit, for example, a chiller 10 utilizing a falling film evaporator 12. A flow of vapor refrigerant 14 is directed into a compressor 16 and then to a condenser 18 that outputs a flow of liquid refrigerant 20 to an expansion valve 22. The expansion valve 22 outputs a vapor and liquid refrigerant mixture 24 to the evaporator 12. A thermal energy exchange occurs between a flow of heat transfer medium 28 flowing through a plurality of evaporator tubes 26 into and out of the evaporator 12 and the vapor and liquid refrigerant mixture 24. As the vapor and liquid refrigerant mixture 24 is boiled off in the evaporator 12, the vapor refrigerant 14 is directed to the compressor 16.

Figure 2:
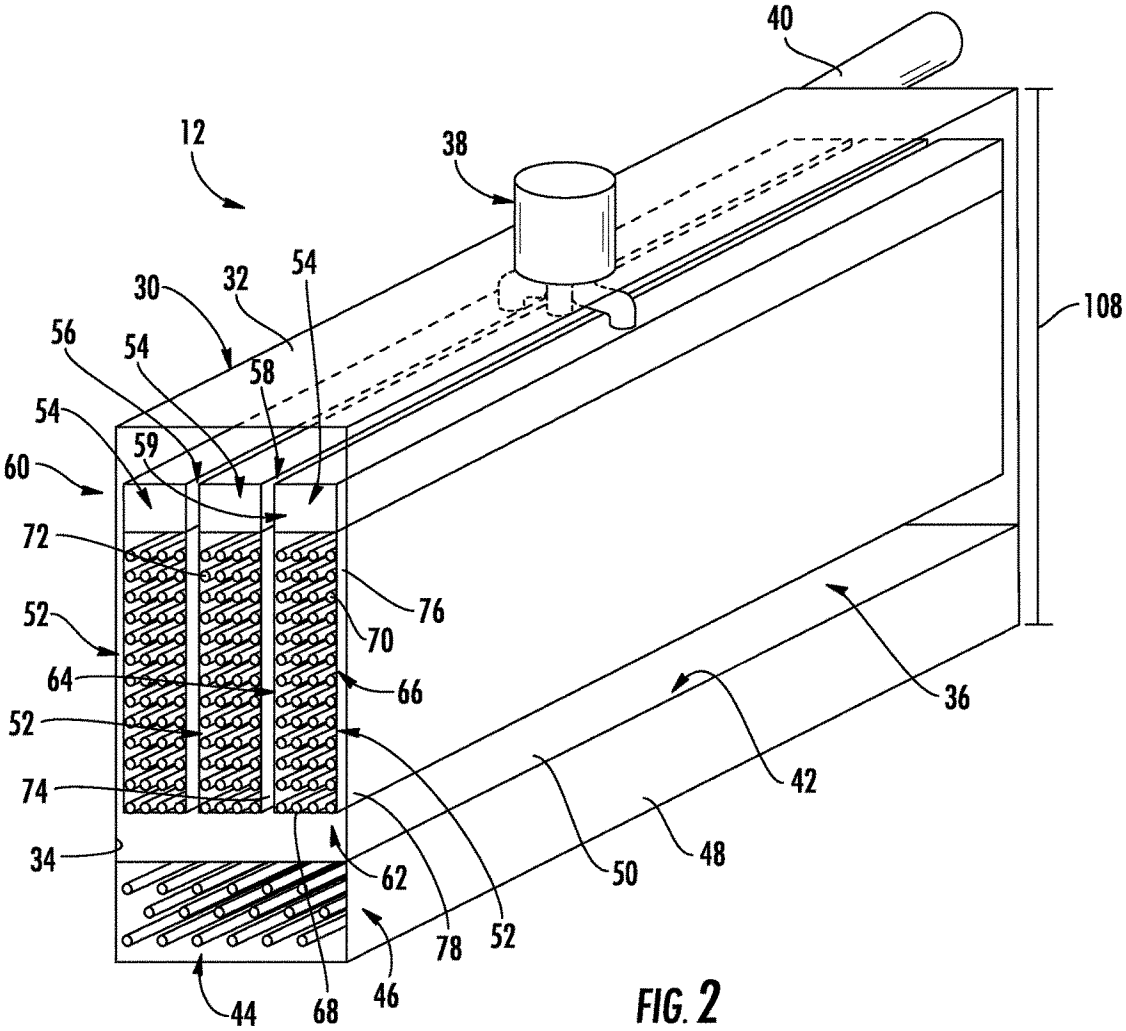
FIG. 2 is a schematic view of an embodiment of a falling film evaporator for an HVAC system.

Referring now to FIG. 2, as stated above, the evaporator 12 is a falling film evaporator. The evaporator 12 includes a shell 30 having an outer surface 32 and an inner surface 34 that define a heat exchange zone 36. In the exemplary embodiment shown, shell 30 includes a non-circular cross-section. As shown, shell 30 includes a rectangular cross-section however, it should be understood that shell 30 can take on a variety of forms including both circular and non-circular. Shell 30 includes a refrigerant inlet 38 that is configured to receive a source of refrigerant (not shown). Shell 30 also includes a vapor outlet 40 that is configured to connect to an external device such as the compressor 16. Evaporator 12 is also shown to include a refrigerant pool zone 42 arranged in a lower portion of shell 30. Refrigerant pool zone 14 includes a pool tube bundle 44 that circulates a fluid through a pool of refrigerant 46. Pool of refrigerant 46 includes an amount of liquid refrigerant 48 having an upper surface 50. The fluid circulating through the pool tube bundle 44 exchanges heat with pool of refrigerant 46 to convert the amount of refrigerant 48 from a liquid to a vapor state. In some embodiments, the refrigerant may be a "low pressure refrigerant" defined as a refrigerant having a liquid phase saturation pressure below about 45 psi (310.3 kPa) at 104° F. (40° C.). An example of low pressure refrigerant includes R245fa.

In accordance with the exemplary embodiment shown, evaporator 12 includes a plurality of tube bundles 52 that provide a heat exchange interface between refrigerant and another fluid. Each tube bundle 52 may include a corresponding refrigerant distributor 54. Refrigerant distributors 54 provide a uniform distribution of refrigerant onto tube bundles 52 respectively. As will become more fully evident below, refrigerant distributors 54 deliver a refrigerant onto the corresponding ones of tube bundles 52. Tube bundles 52 are spaced one from another to form first and second vapor passages 56 and 58. In addition, tube bundles 52 are spaced from inner surface 34 to establish first and second outer vapor passages 60 and 62.

In further accordance with the exemplary embodiment shown, tube bundle 52 includes first and second wall members 64 and 66. First and second wall members 64 and 66 are spaced one from another to define a tube channel 68 through which pass a plurality of tubes 70 that are configured to carry a liquid. As will become more fully evident below, liquid passing through the plurality of tubes 70 is in a heat exchange relationship with the refrigerant flowing into tube channel 68. First wall member 64 includes a first end 72 that extends to a second end 74. Similarly, second wall member 66 includes a first end 76 that extends to a second end 78. Each first end 72 and 76 is spaced below refrigerant distributor 54 while each second end 74 and 78 is spaced above refrigerant pool 46. With this arrangement, liquid refrigerant flowing from refrigerant distributor 54 flows, under force of gravity, through tube channel 68, over tubes 70 and passes into low pressure refrigerant pool 46. In this manner, the refrigerant reduces a temperature of liquid flowing through tubes 70 before transitioning to a vapor for return to, for example, the compressor 16.

Figure 3:
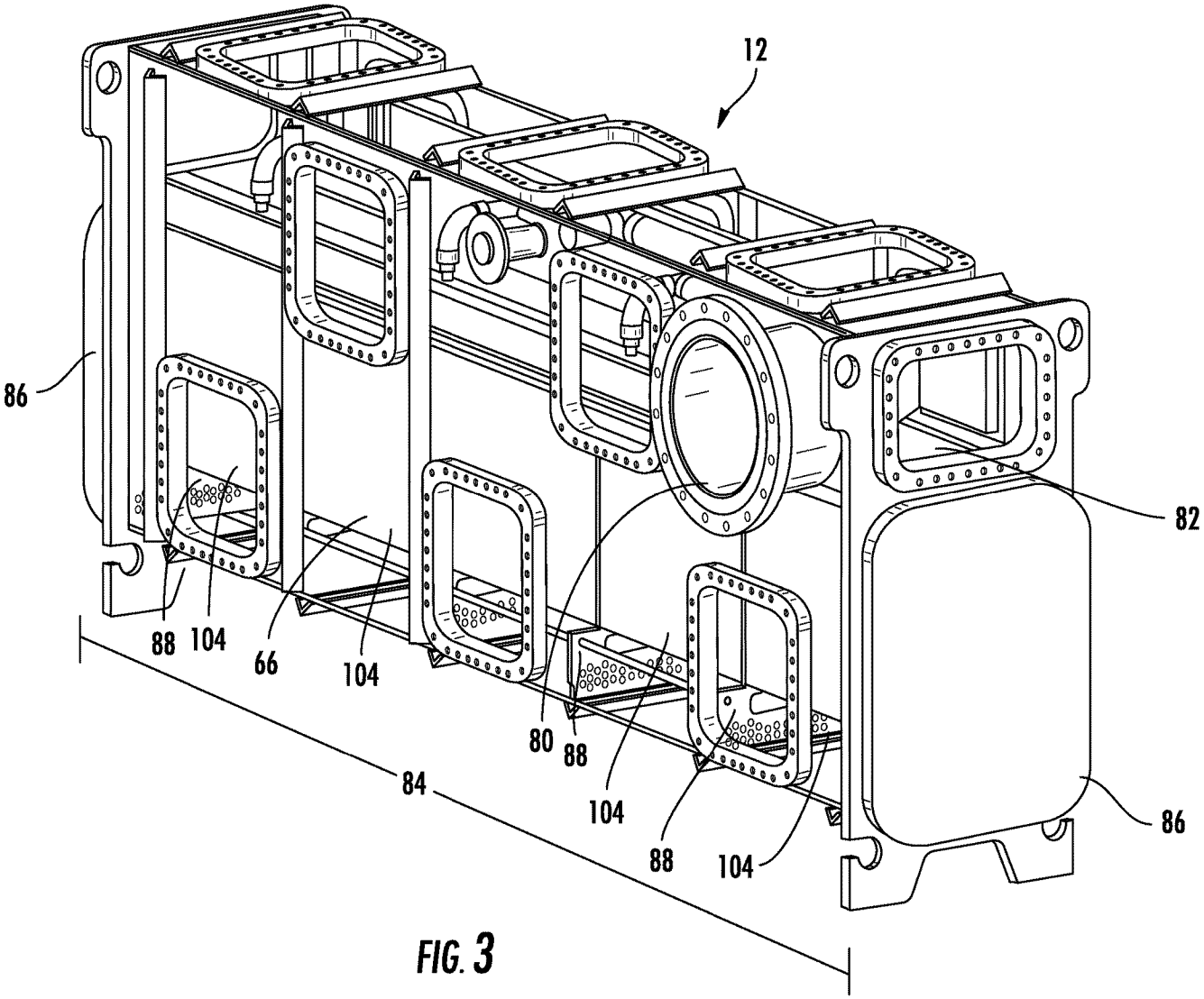
FIG. 3 is a perspective view of an embodiment of a falling film evaporator for an HVAC system.

Referring to FIG. 3, the vapor is removed from the evaporator 12 at a suction nozzle 80. To protect the compressor 16 from refrigerant droplets that may be entrained in the vapor, the evaporator 12 includes a baffle 82 installed between the suction nozzle 80 and the vapor flow area directly around the suction nozzle 80. This results in the baffle 82 blocking at least a portion of a length 84 of the evaporator 12, effectively deactivating the portions of the vapor passages 56 and 58 (shown in FIG. 2) blocked by the baffle 82. The tubes 70 extend along the length 84 of the evaporator 12 below the baffle 82 and between end sheets 86. The tubes 70 are further supported along the length 84 by support sheets 88 positioned intermittently along the length 84 between end sheets 86. The support sheets 88 divide the evaporator 12 into a number of vapor passage segments 104.

Figure 4:
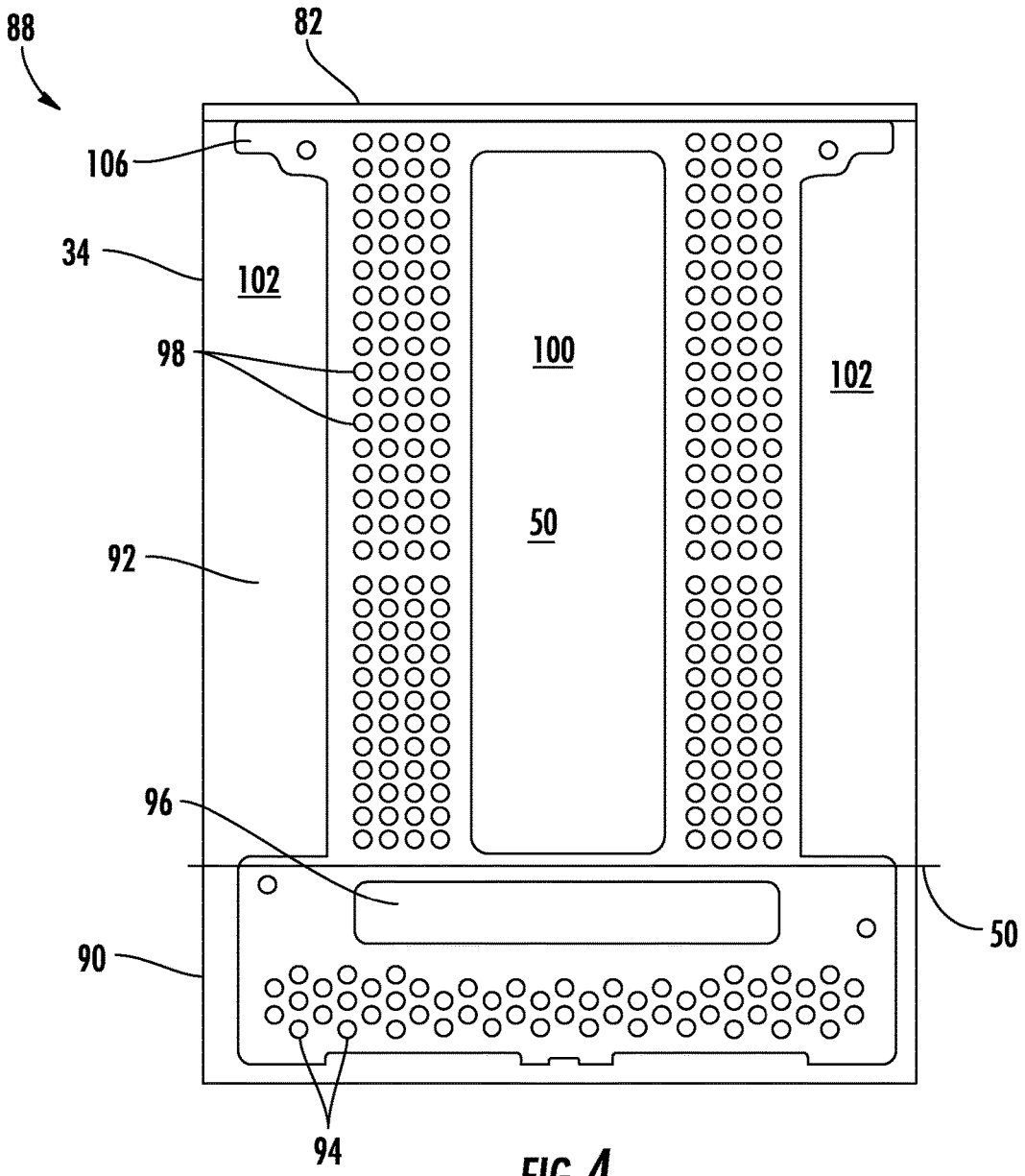
FIG. 4 is an end view of an embodiment of a support sheet for an evaporator of an HVAC system.

Referring to FIG. 4, the support sheets 88 are configured to allow greater flow along the length 84 in the vapor passages 56 and 58. Each support sheet 88 is configured with a pool portion 90 and a tube bundle portion 92 extending upwardly from the pool portion 90. The pool portion 90 includes a plurality of pool bundle openings 94, through which tubes of the pool bundle 44 extend and are supported by the support sheet 88. The pool portion 90 further includes a liquid pool opening 96 above the pool bundle 44, but at least partially below the upper surface 50 of the liquid refrigerant 48, thus encouraging and allowing for flow of the liquid refrigerant 48 along the length 84 of the evaporator 12. The tube bundle portion 92 similarly includes a plurality of tube openings 98 through which tubes 70 of tube bundles 52 extend and are supported. Further, the tube bundle portion 92 includes inner openings 100 between adjacent tube bundles 52, and outer openings 102 between tube bundles 52 and inner surfaces 34. The inner openings 100 and outer openings 102 allow for the flow of vapor along the length 84 of the evaporator between vapor passage segments 104. Flow between vapor passage segments 104 through the inner openings 100 and outer openings 102 allows for redistribution of vapor from the vapor passage segments 104 blocked by the baffle 82 to those vapor passage segments 104 not blocked by the baffle 82.

Further, the support sheets 88 include a cap portion 106 between the tube bundle portion 92 and the baffle 82. In some embodiments, the cap portion 106 abuts the baffle 82, with no gap between the two, since no gap between the cap portion 106 and the baffle 82 is necessary to flow the vapor between vapor passage segments 104, as the inner openings 100 and outer openings 102 serve this purpose. Reduction or elimination of the gap between the cap portion 106 and the baffle 82 allows for an effective shortening of an evaporator height 108 (shown in FIG. 2) compared to prior art evaporator 12 having a large gap between the baffle and the support sheets, and without vapor passage gaps through the support sheets.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A falling film evaporator for a heating ventilation and air conditioning (HVAC) system comprising:

an evaporator housing;

a plurality of evaporator tubes disposed in the evaporator housing and arranged into one or more tube bundles, through which a volume of thermal energy transfer medium is flowed; and one or more support sheets located along a length of the plurality of evaporator tubes to position and support the plurality of evaporator tubes in the housing, the one or more support sheets defining two or more vapor passage segments arranged along a longitudinal length of the evaporator, the one or more support sheets including a plurality of tube openings through which the plurality of evaporator tubes extend, a support sheet of the one or more support sheets including one or more vapor flow openings therethrough entirely perimetrically enclosed by the support sheet to allow flow of vapor refrigerant from a first vapor passage segment of the two or more vapor passage segments through the support sheet and into a second vapor passage segment of the two or more vapor passage segments, along a length of the evaporator.

2. The falling film evaporator of claim 1, comprising two or more tube bundles arranged along a width of the evaporator.

3. The falling film evaporator of claim 2, wherein the vapor flow openings are disposed between adjacent tube bundles.

4. The falling film evaporator of claim 1, wherein the vapor flow openings are disposed between the one or more tube bundles and an inner surface of the housing.

5. The falling film evaporator of claim 1, further comprising:

a suction nozzle through which refrigerant vapor exits the evaporator; and a baffle disposed below the suction nozzle and above an upper extent of the one or more support sheets.

6. The falling film evaporator of claim 1, further comprising a liquid refrigerant pool portion:

a volume of liquid refrigerant; and a pool bundle of evaporator tubes residing therein.

7. The falling film evaporator of claim 6, further comprising a liquid pool opening disposed in the liquid refrigerant pool portion at least partially below an upper surface of the volume of liquid refrigerant.

8. The falling film evaporator of claim 7, wherein the liquid pool opening is disposed above the pool bundle.

9. A heating, ventilation and air conditioning (HVAC) system comprising:

a condenser flowing a flow of refrigerant therethrough;

a falling film evaporator in flow communication with the condenser including:

an evaporator housing;

a plurality of evaporator tubes disposed in the evaporator housing and arranged into one or more tube bundles, through which a volume of thermal energy transfer medium is flowed; and one or more support sheets located along a length of the plurality of evaporator tubes to position and support the plurality of evaporator tubes in the housing, the one or more support sheets defining two or more vapor passage segments arranged along a longitudinal length of the evaporator, the one or more support sheets including a plurality of tube openings through which the plurality of evaporator tubes extend, a support sheet of the one or more support sheets including one or more vapor flow openings therethrough entirely perimetrically enclosed by the support sheet to allow for flow of vapor refrigerant from a first vapor passage segment of the two or more vapor passage segments through the support sheet and into a second vapor passage segment of the two or more vapor passage segments, along a length of the evaporator.

10. The HVAC system of claim 9, comprising two or more tube bundles arranged along a width of the evaporator.

11. The HVAC system of claim 10, wherein the vapor flow openings are disposed between adjacent tube bundles.

12. The HVAC system of claim 9, wherein the vapor flow openings are disposed between the one or more tube bundles and an inner surface of the housing.

13. The HVAC system of claim 9, further comprising:

a suction nozzle through which refrigerant vapor exits the evaporator; and a baffle disposed below the suction nozzle and above an upper extent of the one or more support sheets.

14. The HVAC system of claim 9, further comprising a liquid refrigerant pool portion:

a volume of liquid refrigerant; and a pool bundle of evaporator tubes residing therein.

15. The HVAC system of claim 14, further comprising a liquid pool opening disposed in the liquid refrigerant pool portion at least partially below an upper surface of the volume of liquid refrigerant.

16. The HVAC system of claim 15, wherein the liquid pool opening is disposed above the pool bundle.

* * * * *